US007896089B2

(12) United States Patent
Carree

(10) Patent No.: US 7,896,089 B2
(45) Date of Patent: Mar. 1, 2011

(54) SYSTEM AND METHOD FOR FORMING A SEAL IN A WELLBORE

(75) Inventor: Gilles Carree, Regniere-Ecluse (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 66 days.

(21) Appl. No.: 12/235,932

(22) Filed: Sep. 23, 2008

(65) Prior Publication Data

US 2010/0071911 A1 Mar. 25, 2010

(51) Int. Cl.
*E21B 33/127* (2006.01)

(52) U.S. Cl. ..... 166/387; 166/187

(58) Field of Classification Search ..... 166/187, 166/387

See application file for complete search history.

(56) References Cited

U.S. PATENT DOCUMENTS 4,923,007 A * 5/1990 Sanford et al. ..... 277/334
5,361,479 A 11/1994 Sorem
5,363,542 A 11/1994 Sorem et al.
5,439,053 A 8/1995 Eslinger et al.
5,495,892 A * 3/1996 Carisella ..... 166/387
5,507,341 A * 4/1996 Eslinger et al. ..... 166/187
5,613,555 A * 3/1997 Sorem et al. ..... 166/187
7,331,581 B2 2/2008 Xu et al.
7,363,970 B2 4/2008 Corre et al.
2007/0144734 A1 * 6/2007 Xu et al. ..... 166/187

* cited by examiner

*Primary Examiner*—William P Neuder
(74) *Attorney, Agent, or Firm*—Michael L. Flynn; David Hofman; Jody Lynn DeStefan

(57) ABSTRACT

A technique involves a packer formed as an expandable packer with an internal expandable bladder. The internal expandable bladder is surrounded with a plurality of packer slats oriented in a manner to enable expansion and contraction of the packer. Additional features are incorporated into the bladder and/or slats to facilitate repeated expansion and contraction of the packer while limiting leaks between wellbore regions and preventing extrusion of the bladder.

23 Claims, 4 Drawing Sheets

SYSTEM AND METHOD FOR FORMING A SEAL IN A WELLBORE

BACKGROUND

A variety of packers are used in wellbores to isolate specific wellbore regions. A packer is delivered downhole on a tubing string and a packer sealing element is expanded against the surrounding wellbore wall to isolate a region of the wellbore. Often, two or more packers can be used to isolate several regions in a variety of well related applications, including production applications, service applications and testing applications.

In some well applications, slat packers are used to isolate specific regions of wellbores. Slat packers generally are able to support higher differential pressures and higher expansion rates because the slats act as an efficient anti-extrusion barrier for an internal bladder. Slat packers are formed with a tubular rubber bladder covered by metallic slats to support the internal pressure and the mechanical stress to which the packer is submitted. The slats are oriented longitudinally so as to have a high recovery ratio, however the recovery ratio decreases during inflation of the packer. As the packer is inflated, the slats generally slide over each other, but the packer remains totally covered by slats when fully inflated. A rubber sleeve is placed over the layer of slats along their exterior to avoid external leaks between the regions of the well isolated by the packer.

The ability to prevent extrusion of the tubular rubber bladder is important in high-temperature packers because constituents of the internal bladder lose their elastic and mechanical quality at high temperatures. With a slat packer, the internal bladder acts against the layer of slats. However, inflation and deflation of slat packers can be difficult at high hydrostatic pressure because the pressure inside the packer is not balanced with the pressure of the fluid in the well. As a result, the slats are pressed between the internal rubber bladder and the external rubber sleeve which limits the ability of the slats to slide with respect to each other. After several cycles of the packer, unwanted gaps can occur between slats and render the packer susceptible to extrusion of the tubular rubber bladder. Additionally, the rubber material of the sealing layer created by the rubber sleeve also limits the expansion of a slat packer. If the packer is substantially expanded, the rubber material can tear and create a leak. The use of more elastic materials, however, can result in loss of the elastic properties that allow the rubber material to retain its shape after expansion. As a result, the slat packer can be difficult to deflate in a satisfactory manner when such materials are utilized.

SUMMARY

In general, the present invention provides a system and method for use in a wellbore to isolate specific regions in a wellbore. The system and methodology utilize a packer formed as an expandable packer with an internal expandable bladder. The internal expandable bladder is surrounded with a plurality of packer slats oriented in a manner to enable expansion and contraction of the packer. Additional features are incorporated into the bladder and/or slats to facilitate repeated expansion and contraction of the packer while preventing both leaks and extrusion of the bladder.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method that facilitate formation of seals within a wellbore. For example, many types of production and treatment applications involve isolating a specific region or regions along a wellbore. The isolated regions can be created by expanding one or more packers within the wellbore to isolate regions along the wellbore with respect to each other. As described below, one or more slat packers can be moved to a desired position within a wellbore and expanded to form a seal against a surrounding wall, such as a wellbore casing.

In one embodiment, slat packers are uniquely constructed in a manner that reduces friction between slats by forming the slats with coatings. The slat designed enables a good sealing between the axial ends of the packer without using an external sleeve. As result, well fluid can move between the slats and balance the hydrostatic pressure during inflation of the packer. Each slat is linked to an internal bladder in a manner that facilitates expansion/contraction of the packer while ensuring a satisfactory recovery ratio.

In other embodiments, the conventional, external sealing sleeve also can be omitted. For example, the external sleeve can be omitted when the bladder is constructed as a folded bladder to increase the expansion ratio. In this embodiment, the slats are linked to corresponding folds in the bladder so there is no undue extension of the bladder during inflation of the packer. Use of the folded bladder also enables implementation of a variety of materials, such as thermoplastic materials and/or metallic materials that can be in the form of thin metallic sheets. The folded bladder design also allows easy deflation of the packer while applying a lengthwise tension.

Figure 1:
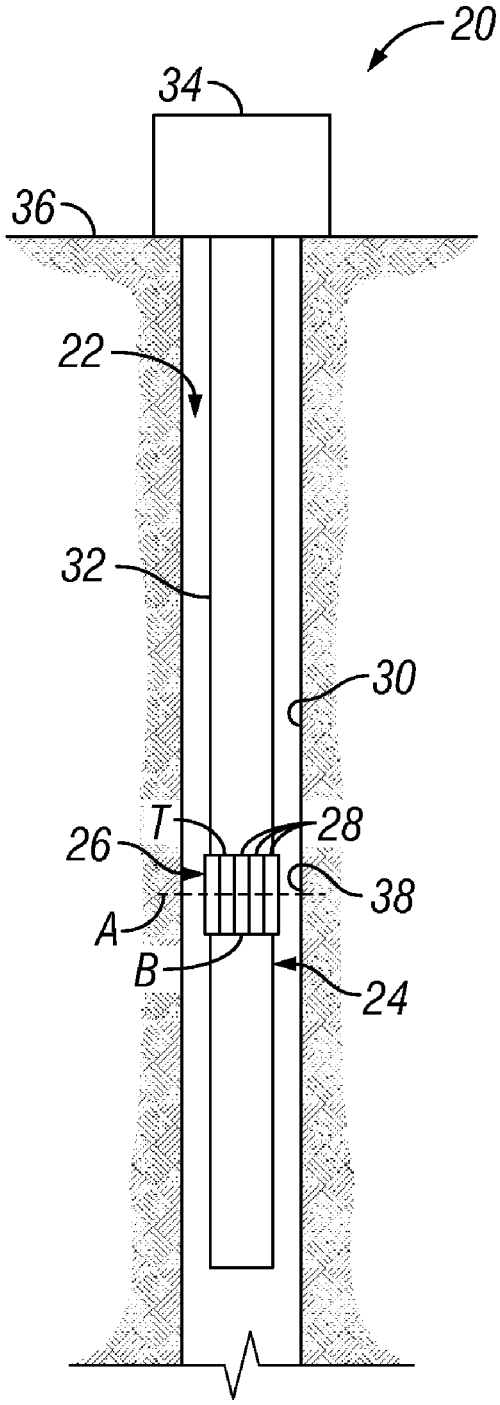
FIG. 1 is a schematic front elevation view of a well system having a packer deployed in a wellbore, according to an embodiment of the present invention.

Referring generally to FIG. 1, one example of a well system 20 is illustrated as deployed in a wellbore 22, according to embodiment of the present invention. The well system 20 comprises a well tool string 24 and at least one packer 26 mounted to the well tool string 24. In this embodiment, packer 26 comprises a slat packer having a plurality of slats 28 that may be disposed in a generally axially directed orientation. In FIG. 1, packer 26 is in a radially contracted configuration to enable movement along wellbore 22 within, for example, a tubular structure 30. By way of example, tubular structure 30 may comprise a well casing or other well tubing. The packer 26 is deployed and retrieved via a conveyance 32 extending downwardly from, for example, a wellhead 34 located at a surface location 36. The conveyance 32 may comprise coiled tubing, production tubing, wireline, slickline, or other suitable conveyances.

Figure 2:
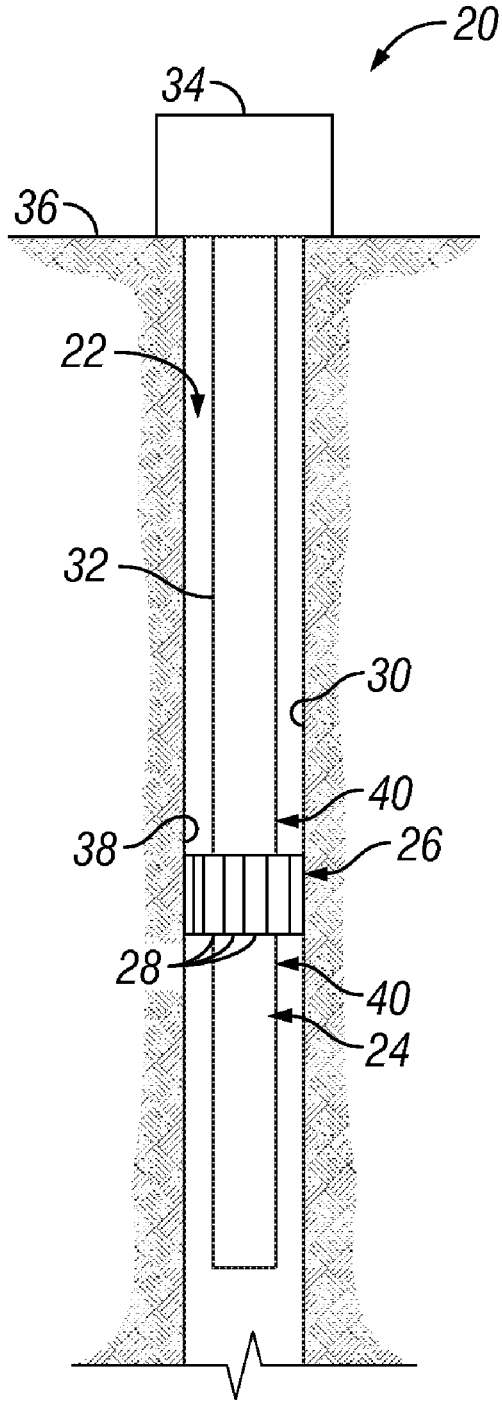
FIG. 2 is a schematic illustration similar to that of FIG. 1 but showing the packer in an expanded configuration, according to an embodiment of the present invention.

As illustrated in FIG. 2, packer 26 can be selectively expanded in a radially outward direction to form a seal with a surrounding wellbore wall/surface 38, such as an inside surface of tubular structure 30. Expansion of the packer 26 to the sealing configuration isolates regions 40 along wellbore 22. Depending on the application, a plurality of packers 26 can be combined with well tool string 24 to create additional isolated regions 40 along wellbore 22.

Figure 3:
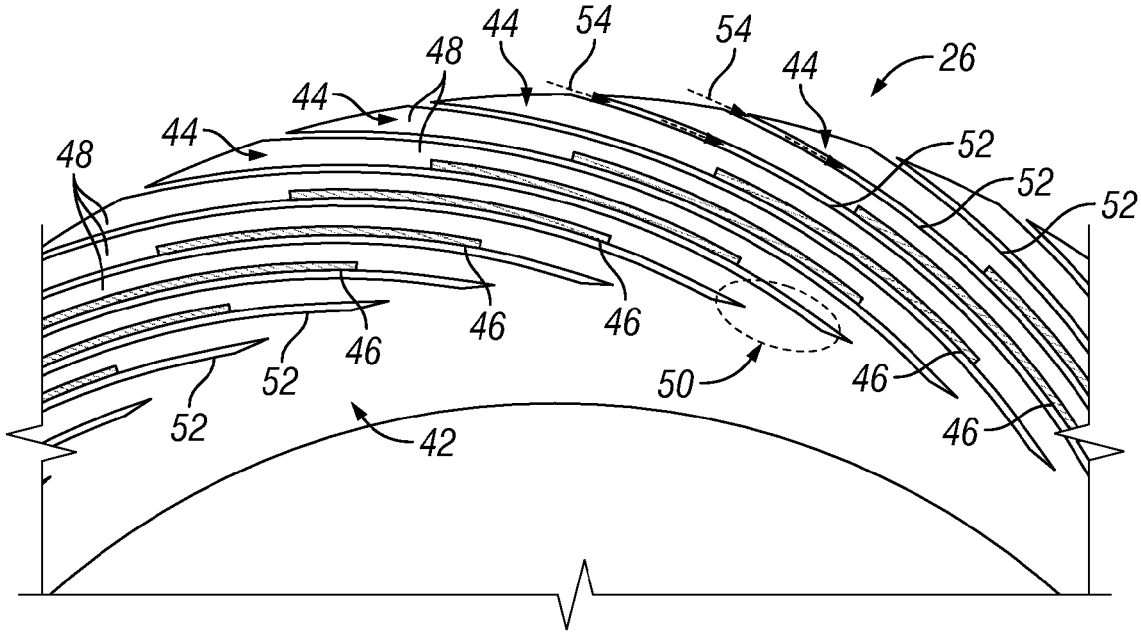
FIG. 3 is a schematic cross-sectional view of a portion of one example of the packer, according to an embodiment of the present invention.

Referring generally to FIG. 3, one embodiment of packer 26 is illustrated in a partial cross-sectional view taken generally transversely with respect to the axis of packer 26. In this embodiment, packer 26 comprises an internal expandable bladder 42 and a plurality of slats 44 surrounding the expandable bladder 42. By way of example, internal expandable bladder 42 may be formed from an elastomeric material, such as rubber, that allows the expandable bladder 42 to be repeatedly expanded and contracted in a radial direction. In the example illustrated, each slat 44 comprises a stiff core 46 combined with a seal material 48 able to form a secure seal with surface 38 upon expansion of packer 26.

The packer slats 44 are attached to expandable internal bladder 42 at attachment regions 50. By way of example, slats 44 can be attached to expandable bladder 42 by gluing, vulcanization, or other suitable attachment mechanisms. Furthermore, packer slats 44 are oriented and attached to internal expandable bladder 42 in a manner such that gaps 52 are formed between adjacent slats 44 while packer 26 is in the contracted configuration and during expansion of packer 26 toward surrounding surface 38. The gaps 52 allow fluid in the well to penetrate into the mechanical structure of packer 26 between adjacent slats 44, as represented by arrows 54. The inflow of well fluid between slats 44 enables equalization of hydrostatic pressure so the slats 44 are not pressed against each other under hydrostatic pressure during expansion of packer 26. The fluid between slats facilitates relative movement of adjacent packer slats during expansion of expandable bladder 42 and packer 26. The formation of separated slats 44 comprising seal material 48 eliminates the need for an external sealing sleeve.

Figure 4:
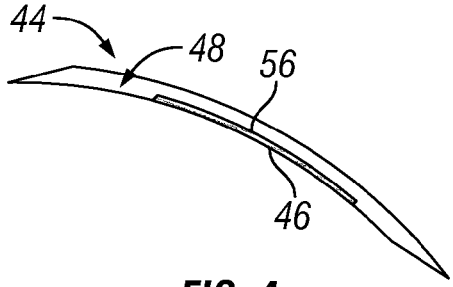
FIG. 4 is an illustration of one example of a slat for use with the packer, according to an embodiment of the present invention.
Figure 5:
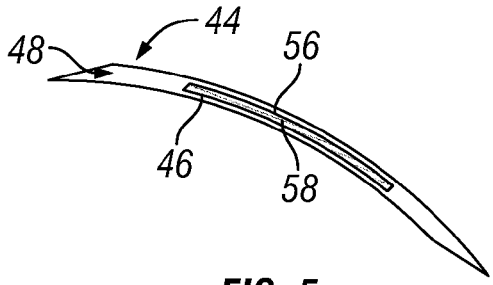
FIG. 5 is an illustration of another example of a slat for use with the packer, according to an alternate embodiment of the present invention.

In FIG. 4, one example of a slat 44 is illustrated in which the stiff core 46 is coated with seal material 48. By way of example, seal material 48 may comprise a rubber material or other suitable seal material. Stiff core 46 may be formed from a metal material, such as steel, a composite material, or other relatively stiff materials. In the embodiment of FIG. 4, seal material 48 is coated along an exterior side 56 of core 46. However, the seal material 48 can be located, e.g. coated, on both the exterior side 56 and an interior side 58 of core 46, as illustrated in FIG. 5.

Figure 6:
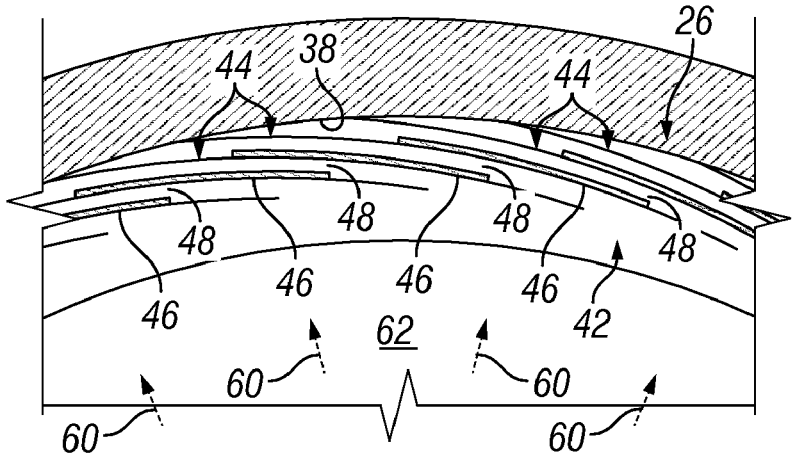
FIG. 6 is a schematic cross-sectional view of a portion of the packer expanded against a surrounding wall, according to an embodiment of the present invention.

During actuation of packer 26 to the sealing configuration illustrated in FIG. 2, the diameter of internal expandable bladder 42 is increased by internal fluid pressure, as represented by arrows 60 in FIG. 6. As internal expandable bladder 42 expands radially outward, gaps 52 enable the slats 44 to easily slide over each other until the packer 26 is fully expanded into sealing engagement with the surrounding wellbore wall 38, as illustrated in FIG. 6. When the packer 26 transitions to the fully inflated/expanded configuration, all slats 44 are pressed against the surrounding wellbore wall 38 until the gaps 52 between slats 44 disappear.

The plurality of slats 44 forms a secure, rigorous seal with respect to the surrounding wall 38. Because no external sleeve is necessary, the risk of losing the seal as a result of damage to the external sleeve is eliminated. Additionally, the risk of leaks along the slats is reduced because the seal material 48 on each individual slat 44 creates a secure seal both with the surrounding wall and between adjacent slats when the packer 26 is inflated to compress the slats 44 against each other. Additionally, fluid in the well can penetrate ends of packer 26 without affecting the seal so there is no need to incorporate additional components or to fill empty space in an effort to combat absolute pressure.

The design of packer 26 also promotes longevity and simplifies the manufacturing process because the packer only requires two layers in the form of expandable bladder 42 and the surrounding layer of slats 44. The structure of slats 44 also enables the use of harder seal materials, such as a hard rubber, for example a 90 shore A rubber. Furthermore, the overall structure of packer 26 allows the packer to be easily deflated while applying a lengthwise tension by simply removing fluid from an interior 62 of expandable bladder 42.

Figure 7:
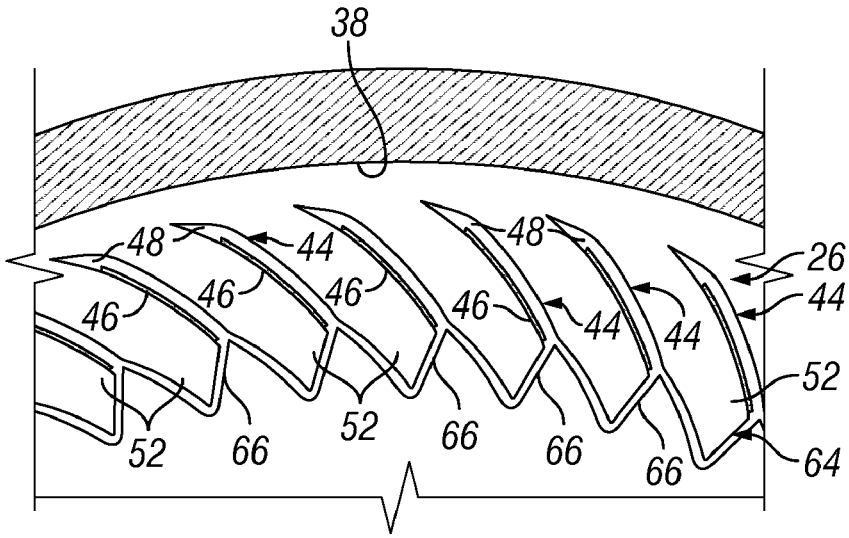
FIG. 7 is a schematic cross-sectional view of a portion of another example of the packer, according to an alternate embodiment of the present invention.
Figure 8:
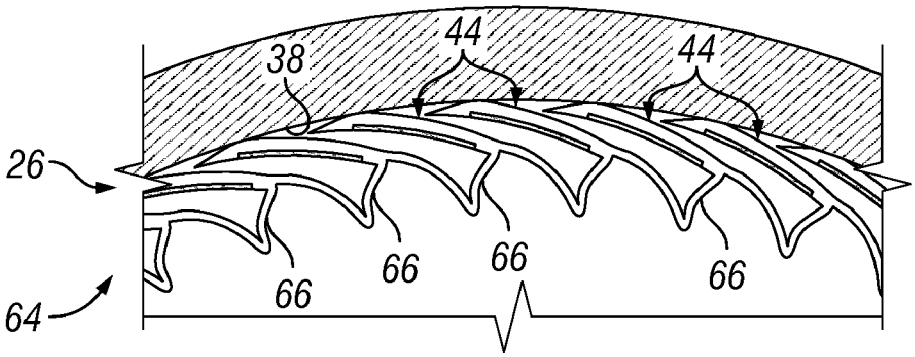
FIG. 8 is a schematic illustration similar to that of FIG. 7 but showing the packer partially expanded toward a surrounding wall, according to an embodiment of the present invention.
Figure 9:
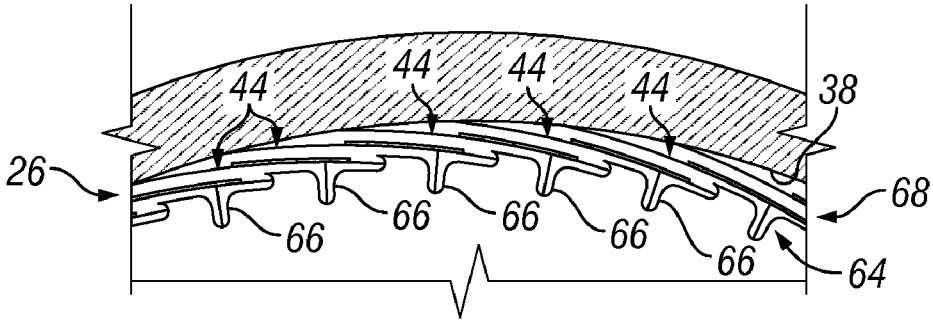
FIG. 9 is a schematic illustration similar to that of FIG. 7 but showing the packer expanded against the surrounding wall, according to an embodiment of the present invention.

Referring generally to FIGS. 7-9, another embodiment of packer 26 is illustrated. In this embodiment, slats 44 are mounted to a foldable bladder 64 that may be designed to provide a substantial expansion ratio. As illustrated in FIG. 7, slats 44 are mounted on corresponding folds 66 of foldable bladder 64. Each slat 44 can again be formed by combining the stiff core 46 and the seal material 48. As described above, seal material 48 may comprise an elastomeric material, such as a rubber material, or other suitable seal materials. Stiff core 46 may be formed from a metal material, e.g. steel, a composite material, or other relatively stiff materials. In some embodiments, seal material 48 is coated along an exterior side of core 46 or along both an exterior and an interior side of core 46.

When the packer 26 is in a contracted configuration or during inflation of packer 26 toward surrounding wall 38, the slats 44 are open in a manner that leaves gaps 52 between adjacent slats. The gaps 52 allow fluid in the well to penetrate the slats which creates a hydrostatic balance that facilitates relative movement of the slats 44 during expansion of packer 26. As illustrated in FIG. 8, radial expansion of packer 26 occurs upon expansion of foldable bladder 64 via transition of the folds 66. The expansion moves slats 44 into engagement with the surrounding wall 38. Continued expansion of packer 26 causes the slats 44 to press against each other and close naturally. The folds 66 of foldable bladder 64 are pressed against the slats 44 to further seal against the slats and create a sealing layer 68, as illustrated in FIG. 9. The sealing layer 68 is able to isolate longitudinally adjacent regions 40 of the wellbore. The packer embodiment described with reference to FIGS. 7-9 enables substantial expansion and easy deflation because the packer can be returned to its original size simply by pulling on the longitudinal extremities of the packer.

Figure 10:
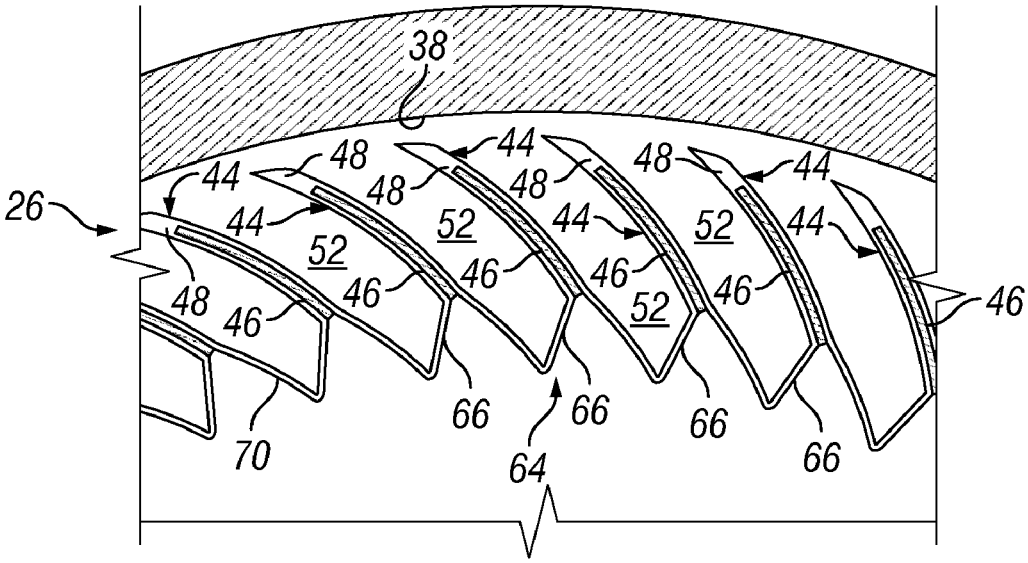
FIG. 10 is a schematic cross-sectional view of a portion of another example of the packer, according to an alternate embodiment of the present invention.
Figure 11:
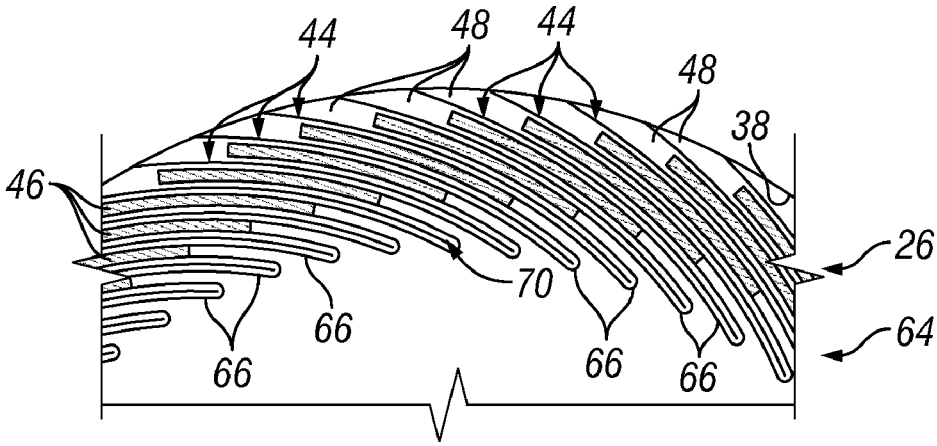
FIG. 11 is a schematic illustration similar to that of FIG. 10 but showing the packer in an expanded configuration, according to an embodiment of the present invention.

The foldable bladder 64 can be formed from an elastomeric material, such as a rubber material, that is formed with folds 66 and coupled to slats 44. In other embodiments, the foldable bladder 64 can be formed with a thermoplastic material or a soft metal material 70 constructed with folds 66, as illustrated in FIG. 10. The slats 44 are attached to the metallic, foldable bladder by, for example, gluing or other bonding techniques. In some applications, soft metal material can be coated or otherwise covered by a rubber material or other elastomeric material. Regardless, expansion of packer 26 causes the folds 66 to transition together as slats 44 are moved into contact with each other and with the surrounding wall 38, as illustrated in FIG. 11. Use of a metallic, foldable bladder enables a high expansion ratio. The metallic material also can facilitate deflation in some applications because transition of the packer from an expanded configuration to a radially contracted configuration does not depend on the elasticity of a rubber material. This allows the packer to be easily transitioned to its original, contracted shape which can facilitate movement of the packer through restrictions in the wellbore.

Use of the foldable bladder 64 requires less deformation of the internal bladder and enables dependable, repeatable inflation and deflation of the slat packer 26. The foldable bladder 64 simply folds and unfolds during corresponding radial movement of the slat packer 26.

The overall well system 20 can be constructed in a variety of configurations for use in many environments and applications. For example, one or more slat packers 26 can be combined with a variety of well tool strings 24 to facilitate well testing operations, well treatment operations, well production operations, and other well related operations. Additionally, the slat packer 26 can be constructed from several types of materials and components. The foldable bladder can be created from various elastomeric materials, metallic materials, composite materials, and other materials that can be folded in a manner to accommodate expansion and contraction of the packer. The slats 44 also can be formed in a variety of shapes and sizes and with individual or combined materials. Depending on the well application and environment, the slat material can be similar or distinct relative to the material used to construct foldable bladder 64. Furthermore, the slat packer 26 can be constructed in a variety of configurations with a variety of additional components/structures integrated into the packer design.

In any of the embodiments described above, the packer 26 may be symmetric about its lateral axis A (see FIG. 1). This allows the packer to be bi-directional. That is, the packer 26 functions equally well whether it is inserted with its top portion T uphole of its bottom portion B, or its bottom portion B uphole of its top portion T.

Also, in any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%. Components suitable for the rubbers described in this paragraph include, but are not limited to, internal expandable bladder 42, seal material 48, and foldable bladder 64.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a wellbore, comprising:

a packer comprising an internal, expandable bladder and a plurality of slats surrounding the expandable bladder, each slat of the plurality of slats being formed with a stiff core covered at least in part with a seal material, wherein the plurality of slats is positioned to form gaps between adjacent slats during expansion of the packer.

2. The system as recited in claim 1, wherein the seal material comprises a rubber material.

3. The system as recited in claim 2, wherein each slat comprises the stiff core coated by the rubber material.

4. The system as recited in claim 3, wherein the stiff core comprises a metal core.

5. The system as recited in claim 3, wherein the seal material is disposed along an exterior side of the stiff core.

6. The system as recited in claim 3, wherein the seal material is disposed along both an exterior side and an interior side of the stiff core.

7. The system as recited in claim 1, further comprising a well tool string sized for deployment into the wellbore, the packer being mounted on the well tool string.

8. The system as recited in claim 1, wherein the seal material comprises an oil resistant rubber material.

9. The system as recited in claim 8, wherein the oil resistant rubber material is chosen from the group consisting of nitrite butadiene rubber, hydrogenated nitrile butadiene rubber, and a fluoroelastomer.

10. The system as recited in claim 8, wherein the oil resistant rubber material comprises a hydrogenated nitrite butadiene rubber comprising a percentage of acrylonytrile in the range of approximately 21 to approximately 49 percent.

11. A method, comprising:

forming an expandable packer with an internal expandable bladder;

providing each packer slat of a plurality of packer slats with a layer of a seal material; and mounting the plurality of packer slats around the internal expandable bladder in an orientation to allow relative movement of the adjacent packer slats during expansion of the expandable bladder and positioning the plurality of slats to form gaps between adjacent slats when the expandable packer is in a contracted position.

12. The method as recited in claim 11, wherein providing comprises coating a metal slat core with a rubber seal material.

13. The method as recited in claim 11, further comprising mounting the expandable packer on a well tool string.

14. The method as recited in claim 13, further comprising moving the expandable packer and the well tool string downhole into a wellbore; and expanding the expandable packer to form a seal between the seal material and a surrounding wall.

15. A system for use in wellbore, comprising:

a packer comprising a plurality of packer slats mounted to a foldable bladder, the foldable bladder being radially inward of the plurality of packer slats, wherein the foldable bladder folds and unfolds during corresponding radial movement of the packer, and wherein the plurality of packer slats are oriented to form gaps between adjacent packer slats when the packer is in a contracted position.

16. The system as recited in claim 15, wherein the foldable bladder is made from a rubber material having folds that adjust during contraction of the packer.

17. The system as recited in claim 15, wherein the foldable bladder is made from a metal material having folds that adjust during contraction of the packer.

18. The system as recited in claim 15, wherein each packer slat comprises a stiff core covered with a seal material.

19. A method, comprising:

forming an expandable packer with a foldable bladder, forming a plurality of packer slats with a stiff core covered by a seal material; and mounting the plurality of packer slats around the foldable bladder in an orientation to form gaps between adjacent packer slats when the packer is in a contracted position to allow well fluid to move between the packer slats and to allow relative movement of the adjacent packer slats when the foldable bladder is folded and unfolded during corresponding radial movement of the expandable packer.

20. The method as recited in claim 19, further comprising expanding the expandable packer in a wellbore to form a seal between the plurality of packer slats and a surrounding wall.

21. The method as recited in claim 19, further comprising forming each packer slat with a metal core covered by a rubber seal material on at least an outer surface of the metal core.

22. The method as recited in claim 19, wherein forming comprises forming the foldable bladder with an elastomeric material.

23. The method as recited in claim 19, wherein forming comprises forming the foldable bladder with a metal material.

* * * * *